US011585173B2

(12) United States Patent
Funkhouser et al.

(10) Patent No.: US 11,585,173 B2
(45) Date of Patent: Feb. 21, 2023

(54) FLUID FLOW CONTROL DURING WELL TREATMENT

(71) Applicant: THRU TUBING SOLUTIONS, INC., Newcastle, OK (US)

(72) Inventors: Gary P. Funkhouser, Moore, OK (US); Brock W. Watson, Sadler, TX (US)

(73) Assignee: Thru Tubing Solutions, Inc., Newcastle, OK (US)

( * ) Notice: Subject to any disclaimer, the term of this patent is extended or adjusted under 35 U.S.C. 154(b) by 13 days.

(21) Appl. No.: 17/326,086

(22) Filed: May 20, 2021

(65) Prior Publication Data

US 2021/0270101 A1 Sep. 2, 2021

Related U.S. Application Data

(63) Continuation-in-part of application No. 17/101,030, filed on Nov. 23, 2020, now Pat. No. 11,519,240.
(Continued)

(51) Int. Cl.
*E21B 23/06* (2006.01)
*E21B 33/129* (2006.01)
(Continued)

(52) U.S. Cl.
CPC ..... *E21B 23/06* (2013.01); *E21B 23/10* (2013.01); *E21B 23/14* (2013.01); *E21B 33/124* (2013.01); *E21B 33/1293* (2013.01)

(58) Field of Classification Search
CPC ..... E21B 33/124; E21B 33/12; E21B 33/13; E21B 43/12; E21B 43/14
See application file for complete search history.

(56) References Cited

U.S. PATENT DOCUMENTS

2001/0050172 A1* 12/2001 Tolman ..... E21B 33/12 166/305.1
2016/0319628 A1 11/2016 Schultz et al.
(Continued)

FOREIGN PATENT DOCUMENTS

CA 3100648 A1 6/2021
WO WO2019099600 A1 5/2019

OTHER PUBLICATIONS

Evolution Oil Tools Inc.; "G Retrievable Casing Packer", company article, dated May 2014, 3 pages.
(Continued)

*Primary Examiner* — Caroline N Butcher
(74) *Attorney, Agent, or Firm* — Smith IP Services, P.C.

(57) ABSTRACT

A method of treating a subterranean well can include positioning a flow restrictor in a wellbore that penetrates an interval of an earth formation, displacing the flow restrictor along the wellbore away from a surface of the well, preventing longitudinal displacement of the flow restrictor in the wellbore, introducing flow into a first section of the interval from a section of the wellbore between the flow restrictor and the surface, blocking the flow from the wellbore section into the first interval section, permitting longitudinal displacement of the flow restrictor in the wellbore, and displacing the flow restrictor along the wellbore away from the surface of the well, thereby permitting unrestricted flow from the wellbore section into a second section of the interval. The second interval section is farther along the wellbore from the surface than the first interval section.

30 Claims, 10 Drawing Sheets

Related U.S. Application Data

(60) Provisional application No. 62/942,249, filed on Dec. 2, 2019.

(51) Int. Cl.

| | |
|---|---|
| ***E21B 33/124*** | (2006.01) |
| ***E21B 23/10*** | (2006.01) |
| ***E21B 23/14*** | (2006.01) |

(56) References Cited

U.S. PATENT DOCUMENTS

| | | | | |
|---|---|---|---|---|
| 2016/0333680 | A1* | 11/2016 | Richter | E21B 43/26 |
| 2017/0260828 | A1* | 9/2017 | Watson | E21B 23/08 |
| 2018/0163504 | A1 | 6/2018 | Watson et al. | |
| 2021/0270101 | A1 | 9/2021 | Funkhouser et al. | |

OTHER PUBLICATIONS

Halliburton; "Champ V 15K Non-Rotational Retrievable Packer", company article, dated Jun. 2018, 2 pages.
Inflatable Packers International; "Hydraulic Fracturing System", company article, dated 2010-2021, 1 page.
Schlumberger; "Service Packers", company article, dated 2017, 2 pages.
Schlumberger; "Wireline-Set Retrievable Bridge Plug", company article, dated 2017, 1 page.
Canadian Examiner's Report dated Jan. 28, 2022 for CA Patent Application No. 3,100,648, 3 pages.
Office Action dated Feb. 23, 2022 for U.S. Appl. No. 17/101,030, 23 pages.
Canadian Examination Report dated Sep. 9, 2022 for US Patent Application No. 3,119,920, 5 pages.
Office Action dated Aug. 31, 2022 for U.S. Appl. No. 17/101,030, 15 pages.

* cited by examiner

FLUID FLOW CONTROL DURING WELL TREATMENT

CROSS-REFERENCE TO RELATED APPLICATIONS

This application is a continuation-in-part of U.S. application Ser. No. 17/101,030 filed on 23 Nov. 2020, which claims the benefit of the filing date of U.S. provisional application No. 62/942,249 filed on 2 Dec. 2019. The entire disclosures of these prior applications are incorporated herein by this reference.

BACKGROUND

This disclosure relates generally to equipment utilized and operations performed in conjunction with a subterranean well and, in examples described below, more particularly provides for controlling fluid flow during well treatment operations.

In well treatment operations, fluids, gels, slurries, proppant, etc., may be flowed from a wellbore into an earth formation. The treatment of the earth formation is typically most effective if the treatment is performed uniformly across a desired interval along the wellbore.

Therefore, it will be appreciated that improvements are continually needed in the art of treating earth formations. These improvements can result in enhanced uniformity of treatment or control over the treatment (in some circumstances it may be desired to treat one section of an interval more extensively than another section of the interval).

DETAILED DESCRIPTION

Figure 1:
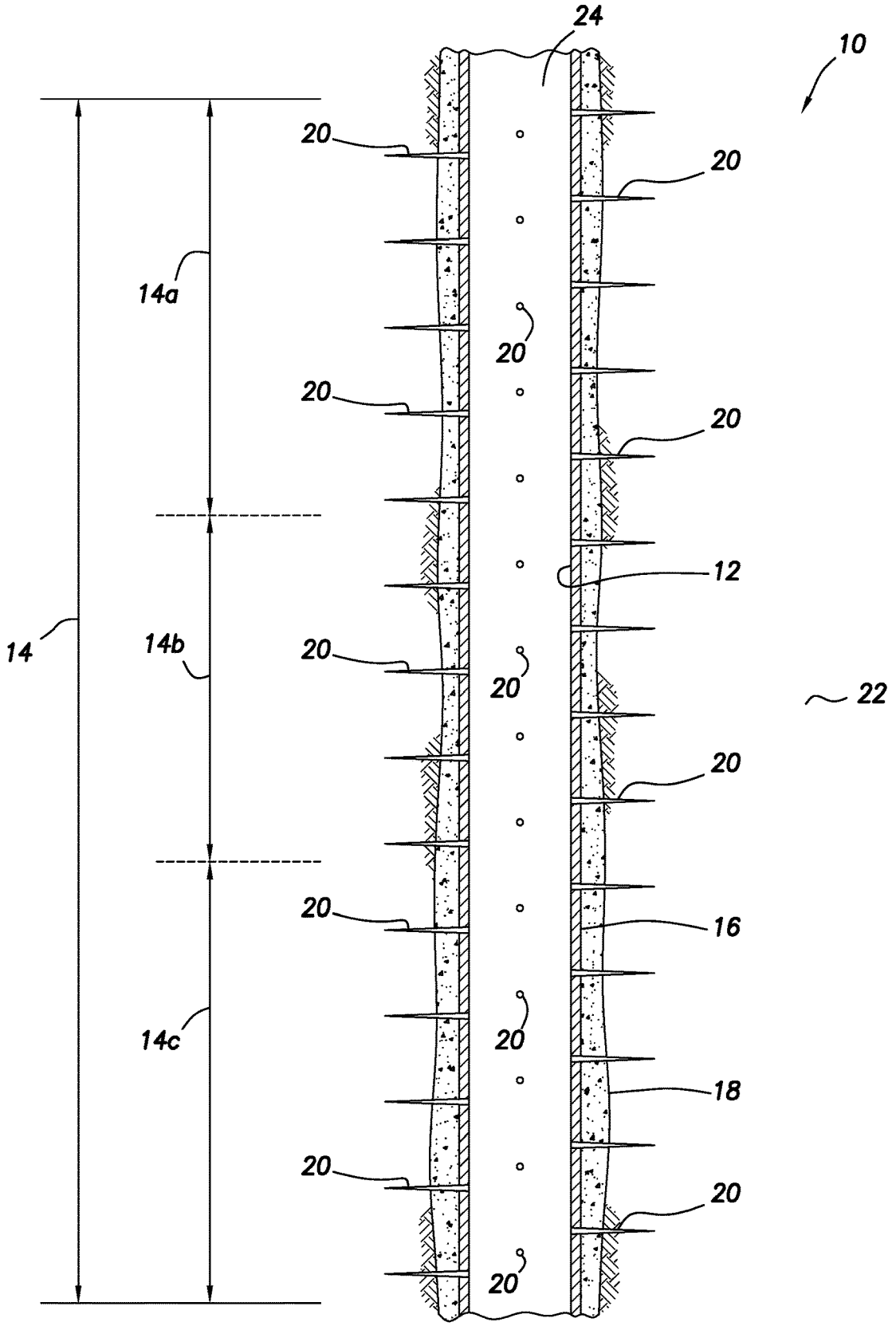
FIGS. 1-6 are representative partially cross-sectional views of successive steps of an example system and method of treating a subterranean well using a downhole tool assembly.

Representatively illustrated in FIGS. 1-6 is a well treatment system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the example depicted in FIG. 1, a wellbore 12 extends through an earth formation zone or interval 14 penetrated by the wellbore. The wellbore 12 is generally vertical, but in other examples the wellbore could be horizontal or otherwise inclined from vertical, and different sections of the wellbore could have respective different orientations.

The wellbore 12 as depicted in FIG. 1 is lined with casing 16 and cement 18. In other examples, the wellbore 12 may not be lined, cased or cemented in the interval 14. The casing 16 may be any type of wellbore lining, such as, liner, casing, tubing or other types of tubulars.

Perforations 20 extend outward through the casing 16 and cement 18, and into an earth formation 22. The perforations 20 provide for fluid communication between the formation 22 and the wellbore 12 (in this example, an interior flow passage 24 of the casing 16). If the wellbore 12 is not lined with casing 16, then the formation 22 can be in fluid communication with the wellbore 12 without use of the perforations 20.

The methods described herein can be used with various types of treatment operations, including but not limited to matrix treatment (such as matrix acidizing, conformance treatment, permeability modifying, etc.), fracturing and re-fracturing the formation 22. The methods can be especially advantageous in situations where the interval 14 is relatively long and/or sufficient pumping capacity is not available to perform the treatment on the entire interval at the same time.

It will be appreciated by those skilled in the art that, in the case of a relatively long interval, a small number of the perforations 20 may take an inordinately large proportion of fluid flow during the treatment, which can cause problems, such as, lack of sufficient flow into other perforations (thereby hindering effective treatment of the entire interval), sanding-out (if fracturing or re-fracturing), etc. Thus, in methods described herein, the interval 14 is divided into multiple sections 14*a-c*, which are individually treated, so that the entire interval 14 is effectively treated. In the FIGS. 1-6 example, the interval 14 is divided into three sections 14*a-c*, but in other examples other numbers of sections may be used.

Figure 2:
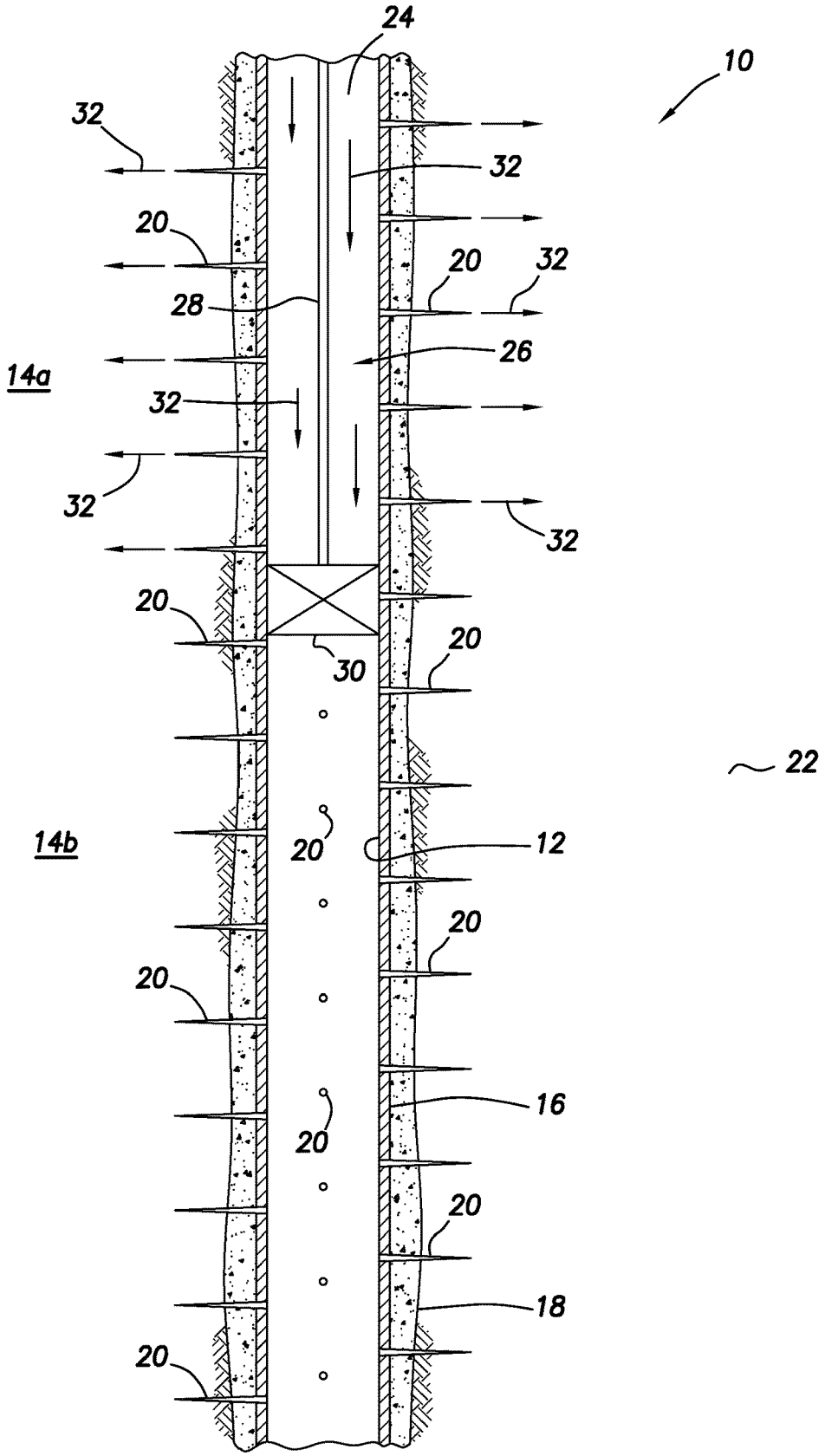

Referring additionally now to FIG. 2, a downhole tool assembly 26 has been conveyed into the wellbore 12. A conveyance 28 (such as, a wireline, slick line, e-line, coiled tubing, etc.) is secured to a flow restrictor 30. Additional, fewer or different tools may be included in the tool assembly 26 in keeping with the principles of this disclosure.

The tool assembly 26 may be lowered into the wellbore 12 using the conveyance 28 and/or flow of a fluid 32 through the wellbore may be used to "push" the tool assembly along the wellbore. In other examples, a tractor device could be included in the tool assembly 26 to displace the tool assembly through the wellbore 12. Thus, the scope of this disclosure is not limited to any particular means of conveying the tool assembly 26 into or through the wellbore 12.

The flow restrictor 30 is configured such that a pressure differential is created across the flow restrictor in response to the flow of the fluid 32 or application of fluid pressure to the wellbore 12 between the flow restrictor and the surface (e.g., at or near the earth's surface, such as, at a land- or water-based well site). For example, the flow restrictor 30 may have an outer diameter that is a close sliding fit in an inner diameter of the casing 16, so that flow through an annulus formed between the flow restrictor and the casing is significantly restricted, thereby causing pressure in the wellbore 12 between the flow restrictor and the surface (on an uphole side of the flow restrictor) to increase relative to pressure in the wellbore on an opposite downhole side of the flow restrictor. As another example, the flow restrictor 30 may sealingly engage the inner diameter of the casing 16, thereby preventing flow through the annulus between the casing and the flow restrictor, so that pressure applied to the wellbore 12 between the flow restrictor and the surface results in the pressure differential being created across the flow restrictor.

The pressure differential across the flow restrictor 30 may be used to convey the tool assembly 26 through the wellbore 12. The conveyance 28 may be used to limit displacement of the tool assembly 26, so that it is eventually conveyed to a desired position in the wellbore 12. Thus, the conveyance 28 can exert a force on the flow restrictor 30 that is directed opposite to a force due to the pressure differential across the flow restrictor, in order to control a position of the flow restrictor along the wellbore 12.

As depicted in FIG. 2, the flow restrictor 30 is positioned in the wellbore 12 between the interval section 14*a* and the interval section 14*b*. The fluid 32 flows into the wellbore 12 between the flow restrictor 30 and the surface. If the flow restrictor 30 does not seal against the casing 16, some of the fluid 32 may flow into the wellbore 12 below the flow restrictor. However, a substantial majority of the fluid 32 preferably flows into the interval section 14*a*, whereby the interval section is treated (e.g., matrix treatment, fracturing, re-fracturing, etc.).

The same fluid 32 may be used to convey the tool assembly 26 through the wellbore 12 and to treat the interval section 14*a*. Alternatively, different fluids may be used to convey the tool assembly 26 and to treat the interval section 14*a*. Note, however, that it is not necessary for any fluid to be used to convey the tool assembly 26 through the wellbore 12 since, as discussed above, other means may be used to convey the tool assembly.

While the interval section 14*a* is treated by the flow of the fluid 32 into the interval section, the conveyance 28 may exert a force on the flow restrictor 30 that is directed opposite to a force due to the pressure differential across the flow restrictor, in order to maintain the flow restrictor in position between the interval sections 14*a,b*. Alternatively, the flow restrictor 30 may be anchored in place by gripping an interior surface of the wellbore 12 or casing 16 while the interval section 14*a* is treated by the flow of the fluid 32 into the interval section.

For example, the flow restrictor 30 could comprise or be of the type known to those skilled in the art as a resettable or retrievable anchor, packer or bridge plug. The anchor, packer or bridge plug may be set prior to treatment of the interval section 14*a*, so that it grips the interior surface of the wellbore 12 or casing 16 while the interval section 14*a* is treated by the flow of the fluid 32 into the interval section.

As used herein, the term "anchor" is used to indicate a securement of the tool assembly 26 against longitudinal displacement through the wellbore 12, or to indicate a tool used to provide such securement. A packer or bridge plug typically includes an anchor (e.g., typically comprising slips or other grip members which grippingly engage an interior surface of a wellbore or tubular). An anchor, packer or bridge plug suitable for use in the well treatment system 10 and method may be set or unset mechanically, hydraulically, electrically or in any other manner.

Figure 3:
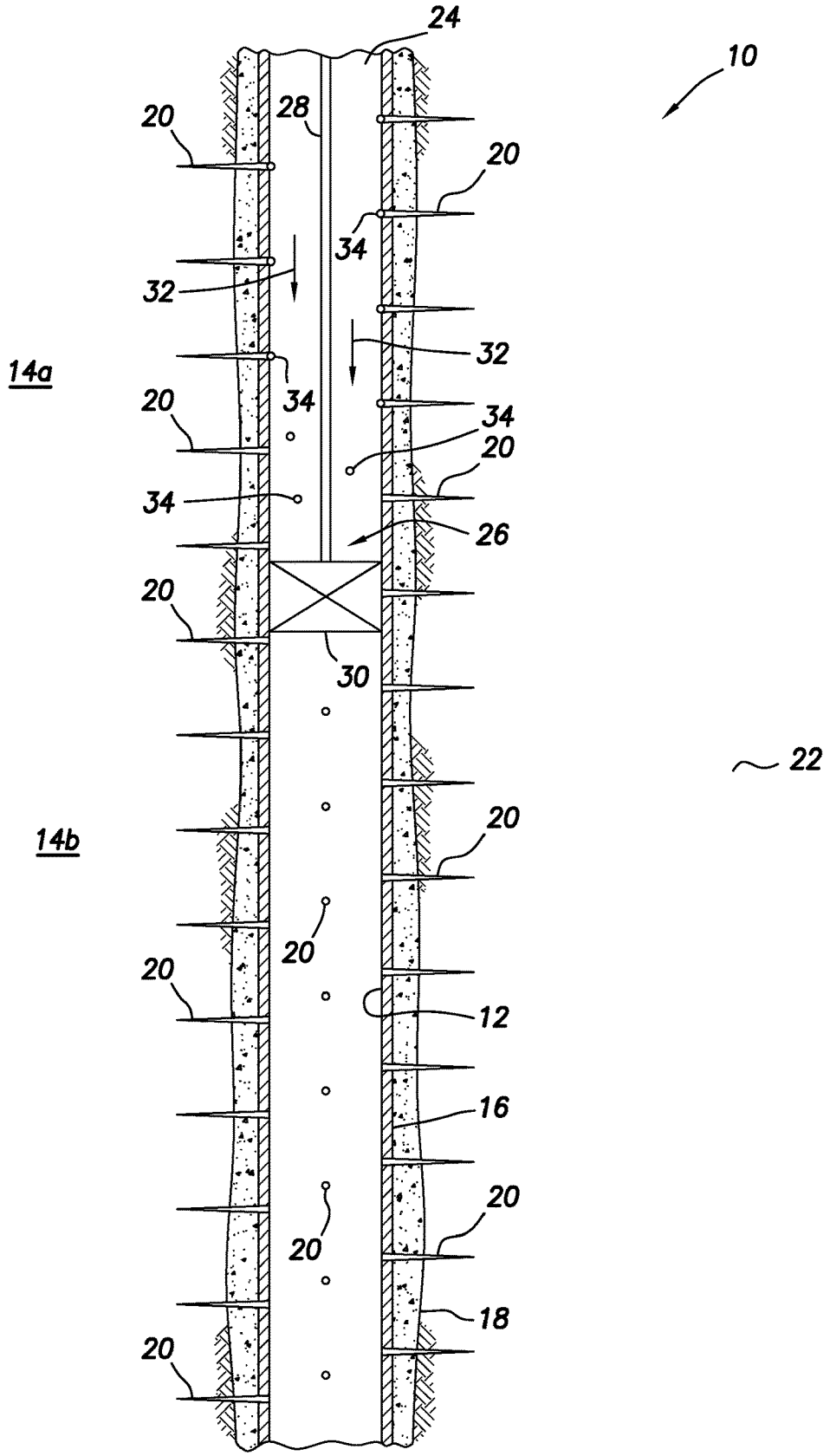

Referring additionally now to FIG. 3, at or near a conclusion of the interval section 14*a* treatment, diverters or plugging devices 34 are used to block flow from the wellbore 12 into the interval section 14*a*. In this example, individual plugging devices 34 sealingly engage and block flow through the perforations 20. In other examples, diverter in the form of particulate matter (such as, calcium carbonate, poly-lactic acid, poly-glycolic acid, etc.) may be used to prevent flow through the perforations 20 (or into a wall of the wellbore 12 if the wellbore is uncased). As used herein, the term "plugging device" is considered to include a diverter that prevents or substantially blocks flow from a wellbore into an earth formation.

The diverter or plugging devices 34 may be conveyed through the wellbore 12 by the flow of the fluid 32 (or another fluid). The diverter or plugging devices 34 may be released into the wellbore 12 at the surface, or they may be released from a container or dispensing device that is part of the tool assembly 26, or they may be otherwise included or conveyed with the tool assembly as described more fully below. Thus, the scope of this disclosure is not limited to any particular means for displacing the diverter or plugging devices 34 into the wellbore 12 above the flow restrictor 30.

In some examples, the diverter or plugging devices 34 may be degradable downhole. In this manner, after the entire interval 14 has been treated, the diverter or plugging devices 34 can eventually degrade (e.g., dissolve, disintegrate, melt, corrode, etc.) and thereby re-establish fluid communication between the formation 22 and the flow passage 24. The diverter or plugging devices 34 may degrade due to contact with a particular degrading substance (such as acid or a fluid having a particular pH range), passage of time, exposure to heat or radiation, etc.

However, it is not necessary for the diverter or plugging devices 34 to degrade in keeping with the principles of this disclosure. For example, the diverter or plugging devices 34 could be dislodged from the perforations 20 or from a wall of the wellbore 12 by production flow from the formation 22 or by mechanical means (such as, a casing scraper or reamer, etc.).

The plugging devices 34 may be similar to, or the same as, any of the plugging devices described in US Publication Nos. 2016/0319628, 2017/0260828 and 2018/0163504, the entire disclosures of which are incorporated herein by this reference.

If the flow restrictor 30 comprises an anchor, packer or bridge plug, then after the diverters or plugging devices 34 are used to block flow from the wellbore 12 into the interval section 14*a*, the anchor, packer or bridge plug may be unset, so that the tool assembly 26 can be conveyed through the wellbore using the conveyance 28 and/or flow of the fluid 32.

Figure 4:
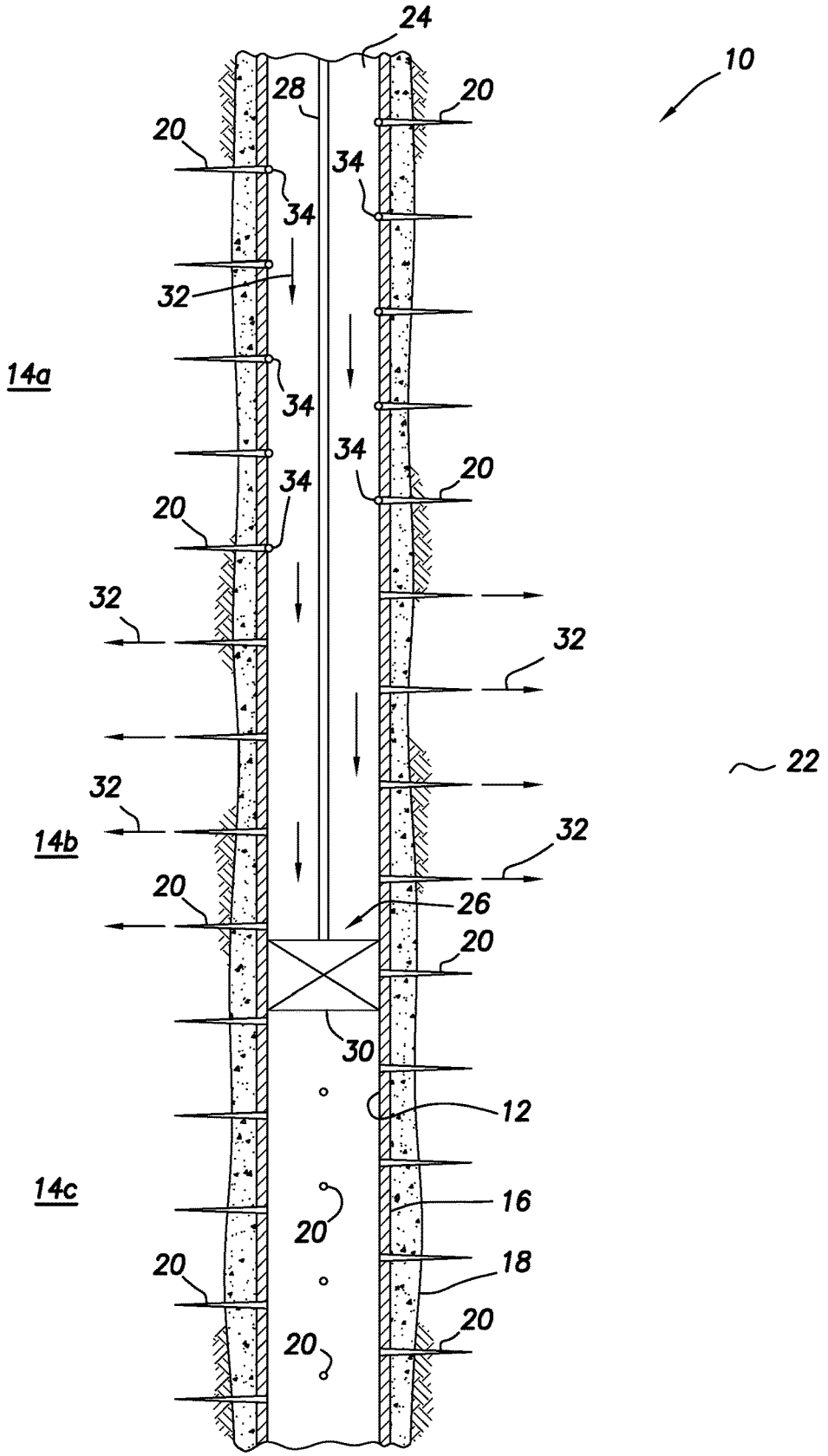
Figure 5:
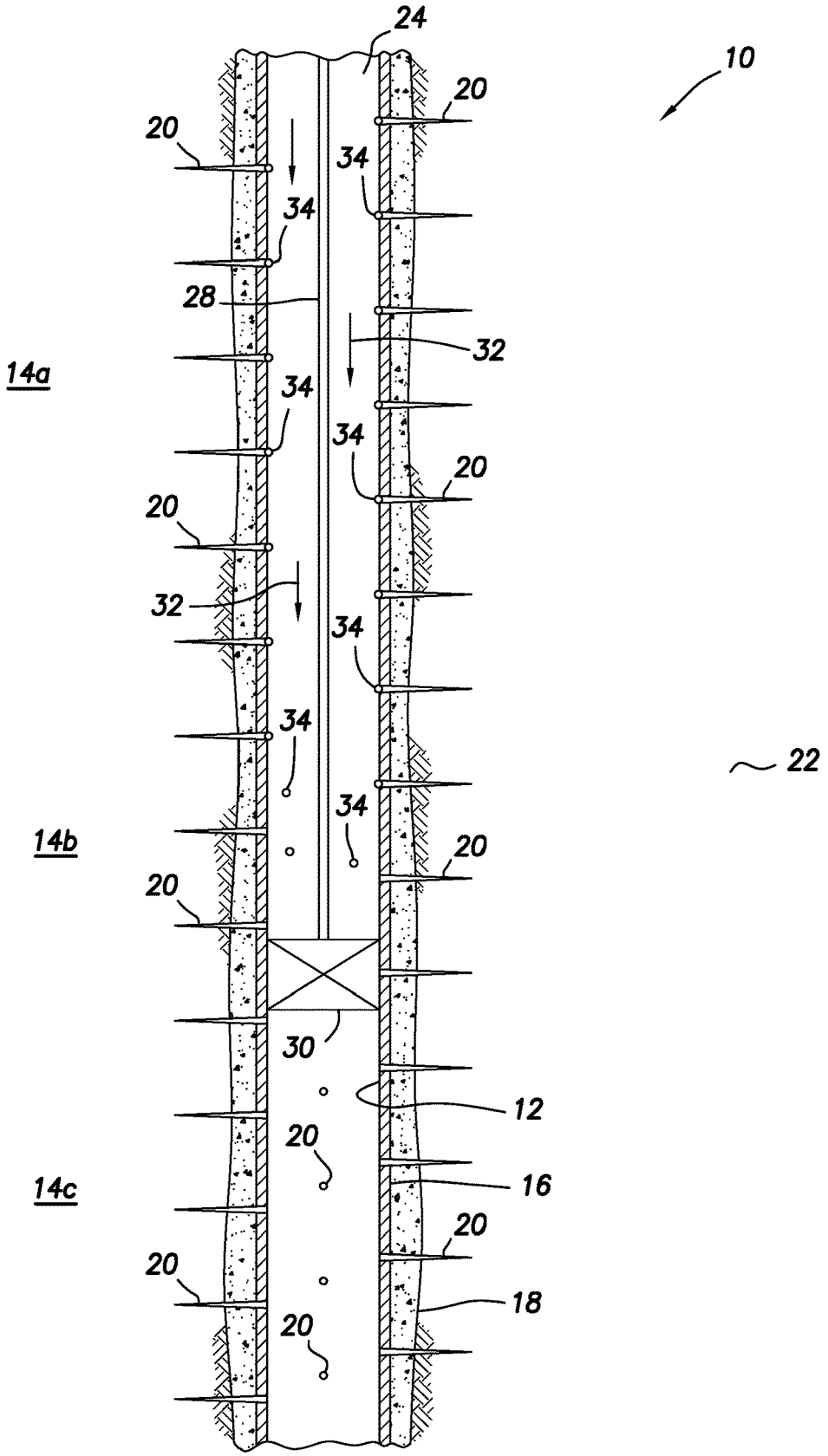

Referring additionally now to FIGS. 4 & 5, the steps described above for treatment of the interval section 14*a* are essentially repeated for treatment of the interval section 14*b*. As depicted in FIG. 4, the flow restrictor 30 is displaced to a position between the interval sections 14*b,c* and the fluid 32 is flowed into the interval section 14*b* to treat the interval section 14*b*.

The fluid 32 that may be used to displace the flow restrictor 30 to the position between the interval sections 14*b,c* or to treat the interval section 14*b* is not necessarily the same fluid as used to displace the flow restrictor to the position between the interval sections 14*a,b*, or the same fluid as used to treat the interval section 14*a*. Different fluids may be used in any of the respective different steps of the method described herein.

Note that the previously placed diverter or plugging devices 34 block flow of the fluid 32 into the interval section 14*a* while the interval section 14*b* is being treated. Thus, all (or substantially all, e.g., if some of the fluid is permitted to flow through the annulus between the flow restrictor 30 and the casing 16) of the fluid 32 flows into the interval section 14*b*, and not into the interval section 14*a* or the interval section 14*c* (although a small amount of the fluid may flow into the interval section 14*c* if some of the fluid is permitted to flow through the annulus between the flow restrictor 30 and the casing 16).

While the interval section 14*b* is treated by the flow of the fluid 32 into the interval section, the conveyance 28 may exert a force on the flow restrictor 30 that is directed opposite to a force due to the pressure differential across the flow restrictor, in order to maintain the flow restrictor in position between the interval sections 14*b,c*. Alternatively, if the flow restrictor 30 comprises an anchor, packer or bridge plug, then the anchor, packer or bridge plug may be set prior to treatment of the interval section 14*b*, so that it grips the interior surface of the wellbore 12 or casing 16 and prevents longitudinal displacement of the tool assembly 26 while the interval section 14*b* is treated by the flow of the fluid 32 into the interval section.

In FIG. 5, additional diverter or plugging devices 34 are used to block flow through the perforations 20 at or near conclusion of the treatment of the interval section 14*b*. The diverter or plugging devices 34 used to block flow into the interval section 14*b* may be the same as, or different from, the diverter or plugging devices 34 used to block flow into the interval section 14*a*.

If the flow restrictor 30 comprises an anchor, packer or bridge plug, then after the additional diverter or plugging devices 34 are used to block flow through the perforations 20 at or near conclusion of the treatment of the interval section 14*b*, the anchor, packer or bridge plug is unset, so that the tool assembly 26 can again be conveyed through the wellbore using the conveyance 28 and/or flow of the fluid 32.

Figure 6:
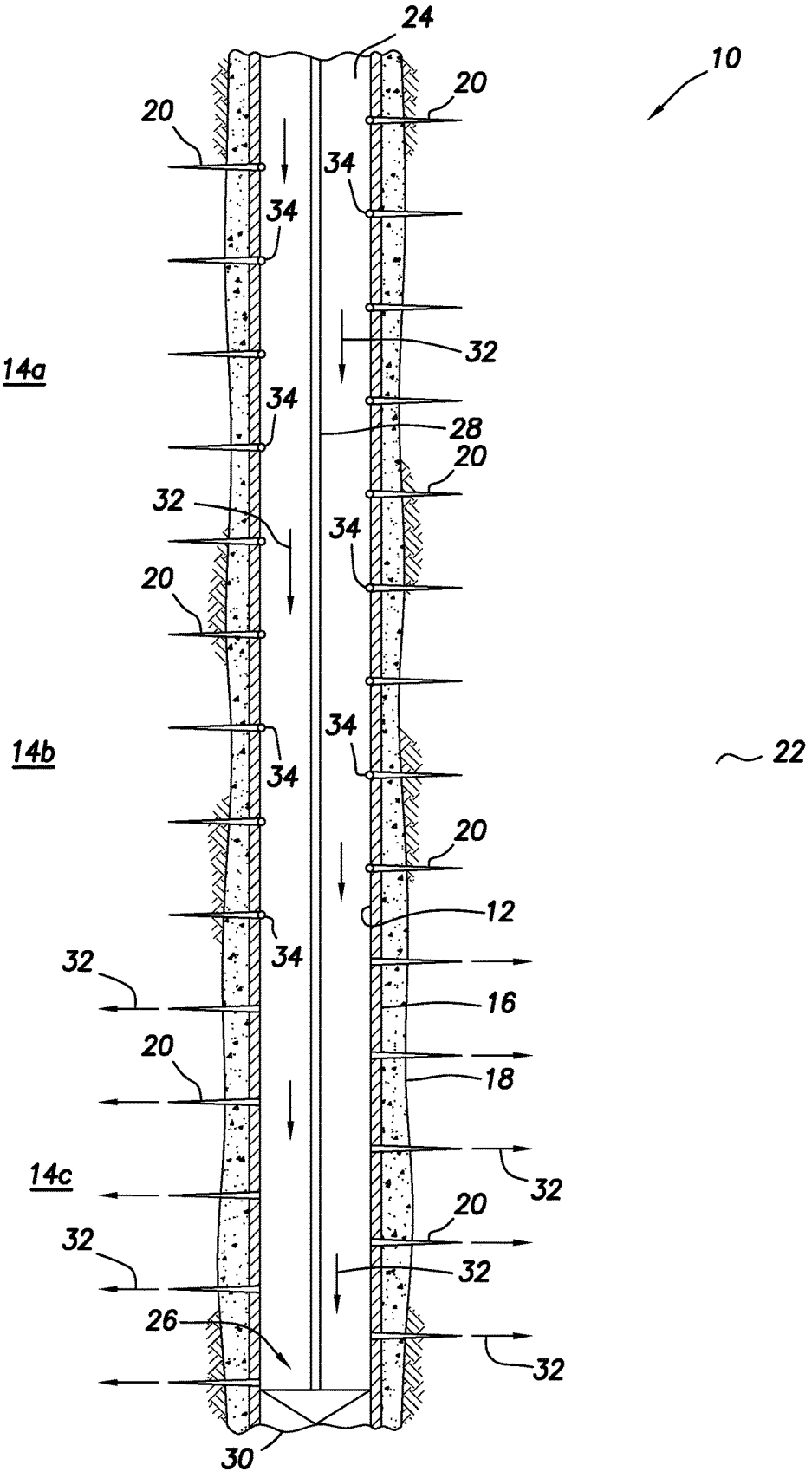

Referring additionally now to FIG. 6, the steps described above for treatment of the interval sections 14*a,b* are essentially repeated for treatment of the interval section 14*c*, except that diverter or plugging devices 34 are not used to block flow of fluid into the interval section 14*c* after treatment of the interval section 14*c* (since it is the only remaining interval section to be treated). However, if additional interval sections were to be treated, then diverter or plugging devices 34 could be used to block flow of fluid into the interval section 14*c* after treatment of the interval section 14*c*.

As depicted in FIG. 6, the flow restrictor 30 is displaced to a position below the interval section 14*c* and the fluid 32 is flowed into the interval section 14*c* to treat the interval section 14*c*. The fluid 32 that may be used to displace the flow restrictor 30 to the position below the interval section 14*c* or to treat the interval section 14*c* is not necessarily the same fluid as previously used to displace the flow restrictor, or the same fluid as used to treat either of the interval sections 14*a,b*.

Note that the previously placed diverter or plugging devices 34 block flow of the fluid 32 into the interval sections 14*a,b* while the interval section 14*c* is being treated. Thus, all (or substantially all, e.g., if some of the fluid is permitted to flow through the annulus between the flow restrictor 30 and the casing 16) of the fluid 32 flows into the interval section 14*c*, and not into the interval sections 14*a,b* (although there could be some leakage of fluid past the plugging devices 34 into the interval sections 14*a,b*).

While the interval section 14*c* is treated by the flow of the fluid 32 into the interval section, the conveyance 28 may exert a force on the flow restrictor 30 that is directed opposite to a force due to the pressure differential across the flow restrictor, in order to maintain the flow restrictor in position below the interval section 14*c*. Alternatively, if the flow restrictor 30 comprises an anchor, packer or bridge plug, then the anchor, packer or bridge plug may be set prior to treatment of the interval section 14*c*, so that it grips the interior surface of the wellbore 12 or casing 16 and prevents longitudinal displacement of the tool assembly 26 while the interval section 14*c* is treated by the flow of the fluid 32 into the interval section.

After all of the interval sections 14*a-c* have been treated, the flow restrictor 30 may be unset (if it comprises an anchor, packer or bridge plug), and the tool assembly 26 may be retrieved from the wellbore 12. Alternatively, the conveyance 28 may be separated from the flow restrictor 30, so that the conveyance may be retrieved from the wellbore 12 and the flow restrictor can remain in the wellbore. The flow restrictor 30 could be made of a material (such as aluminum or poly-lactic acid, etc.) that will eventually degrade in the wellbore 12.

The diverter or plugging devices 34 may eventually degrade to thereby permit unrestricted fluid communication from the interval sections 14*a,b* to the flow passage 24. Alternatively, the plugging devices 34 may be mechanically removed, or they may be displaced by production flow from the interval sections 14*a,b* into the wellbore 12.

Figure 7:
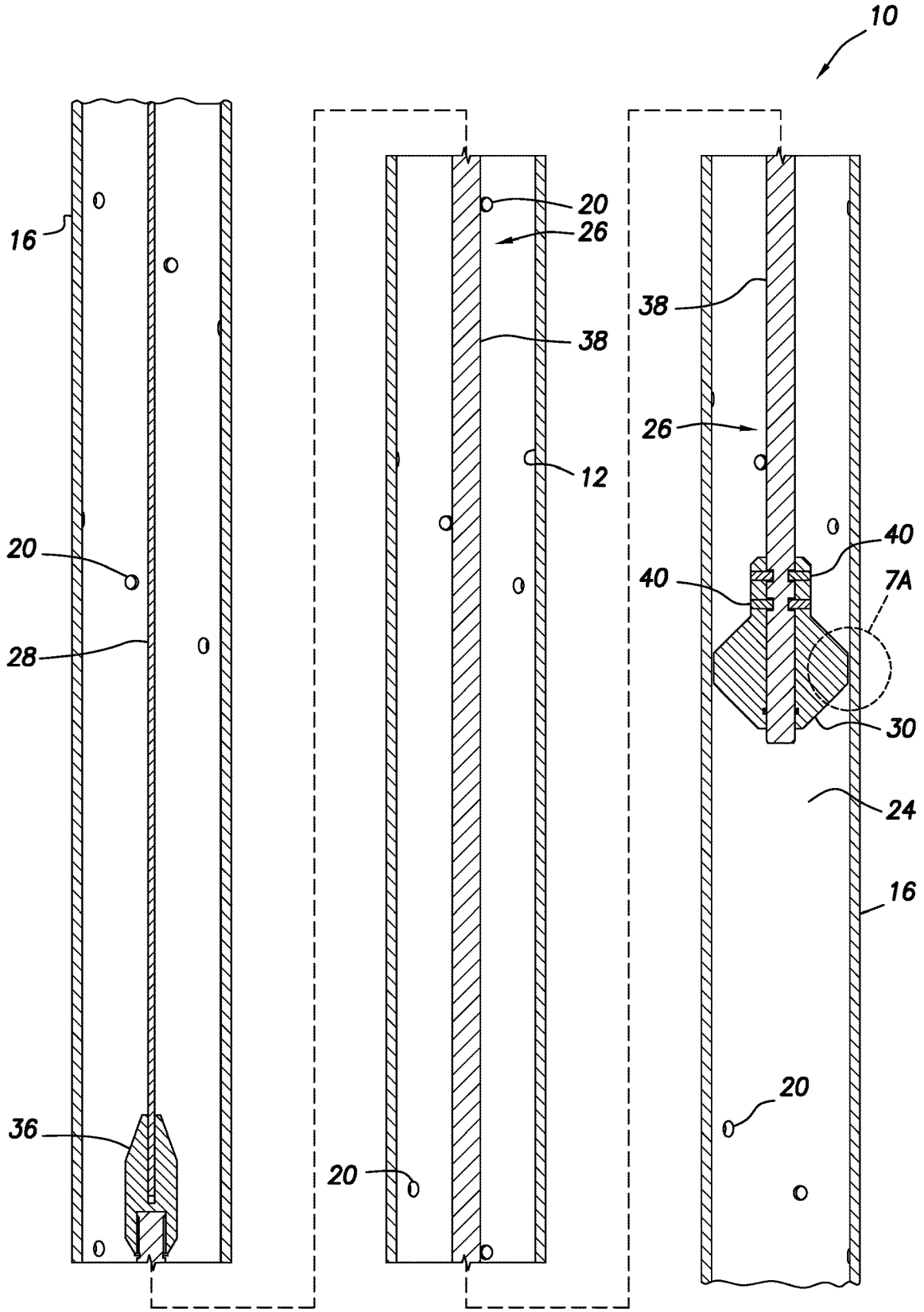
FIG. 7 is a representative cross-sectional view of a more detailed example of the downhole tool assembly in use.

Referring additionally now to FIG. 7, a more detailed representative example of the tool assembly 26 is depicted in the casing 16 and connected to the conveyance 28. In this example, the conveyance 28 is a wireline or slick line connected to the remainder of the tool assembly 26 using a cable head 36 of the type known to those skilled in the art.

The cable head 36 is connected (such as, by threading) to an elongated mandrel 38. The mandrel 38 is, in turn, connected to the flow restrictor 30. In this example, shear pins 40 are used to releasably secure the flow restrictor 30 to the mandrel 38. In this manner, the conveyance 28, cable head 36 and mandrel 38 can be retrieved from the wellbore 12 separately from the flow restrictor 30 (for example, in the event that the flow restrictor becomes stuck in the casing 16).

Figure 7A:
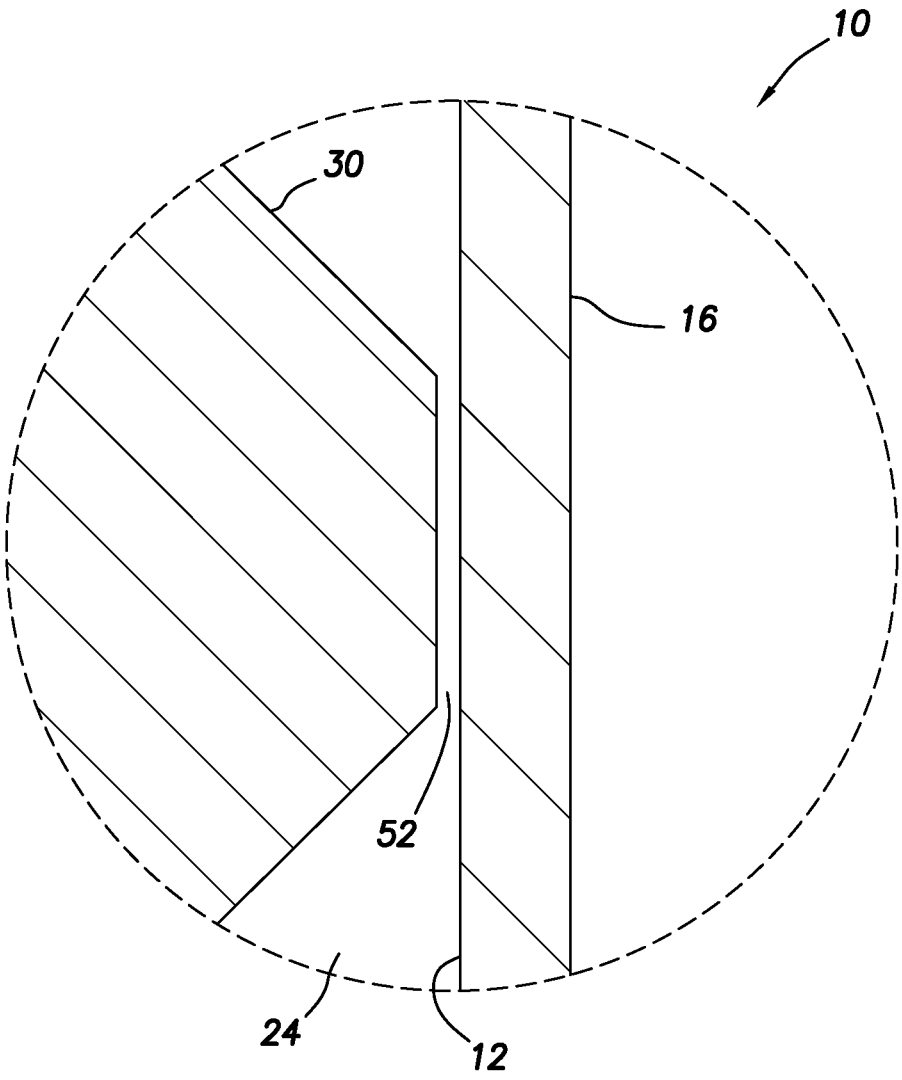
FIG. 7A is a representative cross-sectional view of a portion indicated as 7A in FIG. 7, showing flow through an annulus.

In the FIG. 7 example, the flow restrictor 30 does not sealingly engage the inner diameter of the casing 16. Instead, an outer diameter of the flow restrictor 30 is a close sliding fit within the inner diameter of the casing 16, so that fluid flow through an annulus 52 between the flow restrictor and the casing (see FIG. 7A) is significantly restricted.

However, the flow restrictor 30 could seal against the inner diameter of the casing 16 in other examples (such as, if the flow restrictor comprises a packer or bridge plug). In some examples, the FIG. 7 flow restrictor 30 can comprise an anchor, packer or bridge plug to secure the tool assembly 26 against longitudinal displacement in the wellbore 12 when desired.

A body of the flow restrictor 30 example of FIG. 7 comprises oppositely facing truncated cones. In other examples, other shapes may be used, and the body may be configured or provided with appropriate structures (such as, tortuous passages, flow obstructions, etc.) configured to increase the restriction to fluid flow through the annulus 52 between the flow restrictor 30 and the casing 16.

Figure 8:
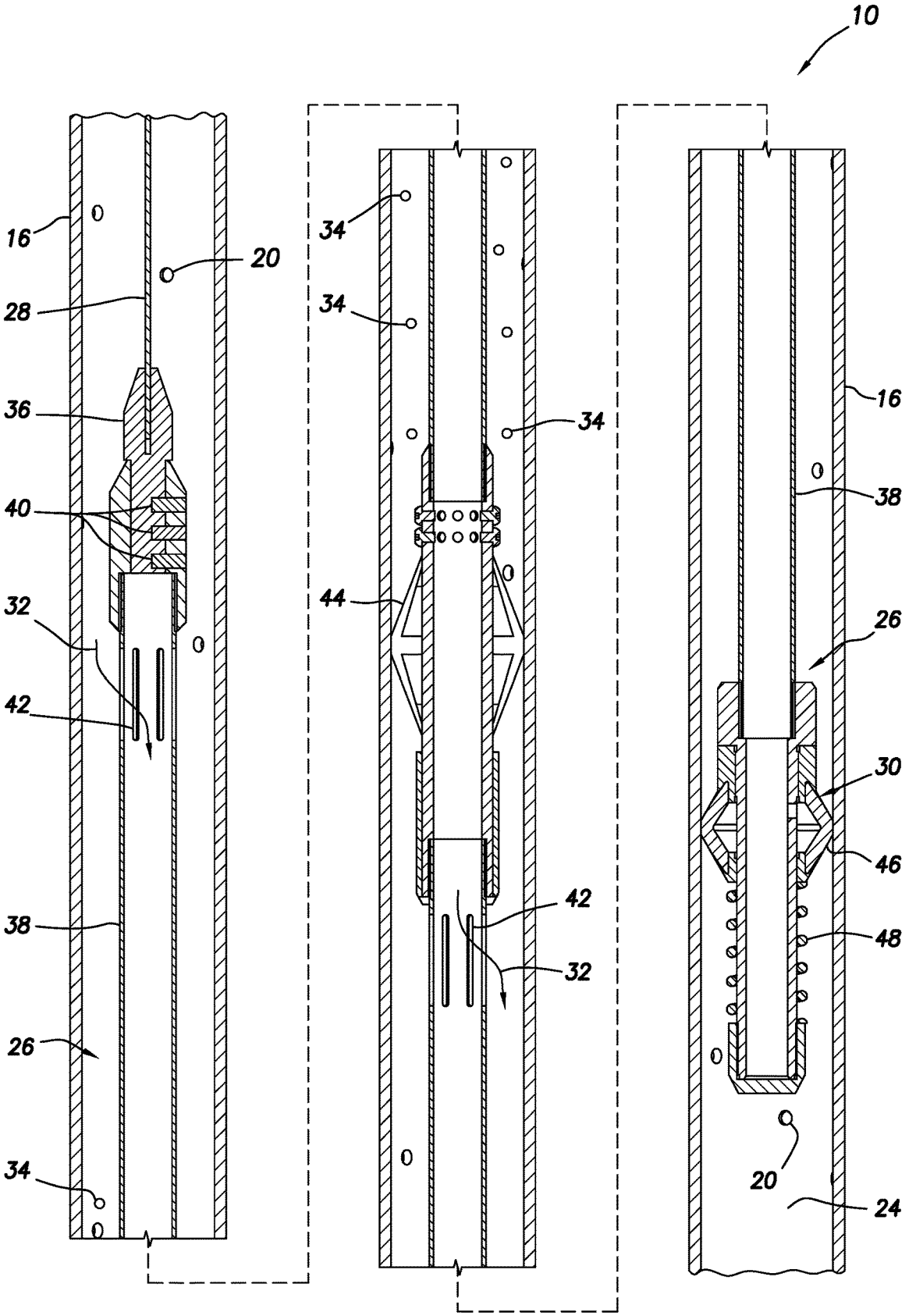
FIG. 8 is a representative cross-sectional view of another example of the downhole tool assembly in use.

Referring additionally now to FIG. 8, another example of the tool assembly 26 is representatively illustrated. In this example, the mandrel 38 is in tubular form, with ports 42 formed through side walls of the mandrel, in order to allow the fluid 32 to flow through an interior of the mandrel.

A plugging device retainer 44 is connected between upper and lower sections of the mandrel 38. The retainer 44 prevents plugging devices 34 from displacing downward to the flow restrictor 30. Thus, the plugging devices 34 can be conveyed with the tool assembly 26 through the wellbore 12.

The plugging devices 34 will engage open perforations 20 above the retainer 44 (in the presence of fluid 32 flow) and, as the tool assembly 26 is conveyed downward through the wellbore 12, the plugging devices will engage additional open perforations as the retainer displaces past the open perforations. The retainer 44 may be degradable in the well.

Note that it is not necessary for the plugging devices 34 to be positioned above the retainer 44 when the tool assembly 26 is deployed into the wellbore 12. In some examples, the plugging devices 34 could be introduced into the wellbore 12 above the tool assembly 26 after the tool assembly is deployed into the wellbore. For example, the plugging devices 34 could be introduced into the wellbore 12 above the tool assembly 26 after each of the interval sections 14*a,b* is treated, or near the conclusion of each interval section treatment.

The tubular mandrel 38 and the ports 42 provide for pressure equalization in the wellbore 12 across the retainer 44 and any plugging devices 34 that may accumulate in the wellbore above the retainer. The retainer 44 may comprise a screen or another structure (such as, similar to a bow-spring type centralizer or an umbrella) capable of preventing the plugging devices 34 from displacing downward to the flow restrictor 30. The retainer 44 can (but does not necessarily) retain an excess number of the plugging devices 34 (greater than the number of open perforations 20) above the retainer, and can maintain open perforations 20 between the retainer and the flow restrictor 30.

The flow restrictor 30 in this example includes a resilient or deformable seal element 46 that sealingly engages the inner diameter of the casing 16. A spring or other biasing device 48 may be used to maintain longitudinal compression of the seal element 46, so that the seal element is continuously biased radially outward into engagement with the casing. The seal element 46 can also deflect radially inward, for example, to pass through reduced inner diameters, obstructions, etc., as needed. In some examples, the FIG. 8 flow restrictor 30 can comprise an anchor, packer or bridge plug to secure the tool assembly 26 against longitudinal displacement in the wellbore 12 when desired.

Note that the cable head 36 is connected to the upper mandrel 38 using the shear pins 40 in this example. Thus, the conveyance 28 and the cable head 36 can be retrieved from the wellbore 12 separately from the remainder of the tool assembly 26 (which may eventually degrade in the wellbore), if needed.

Figure 9:
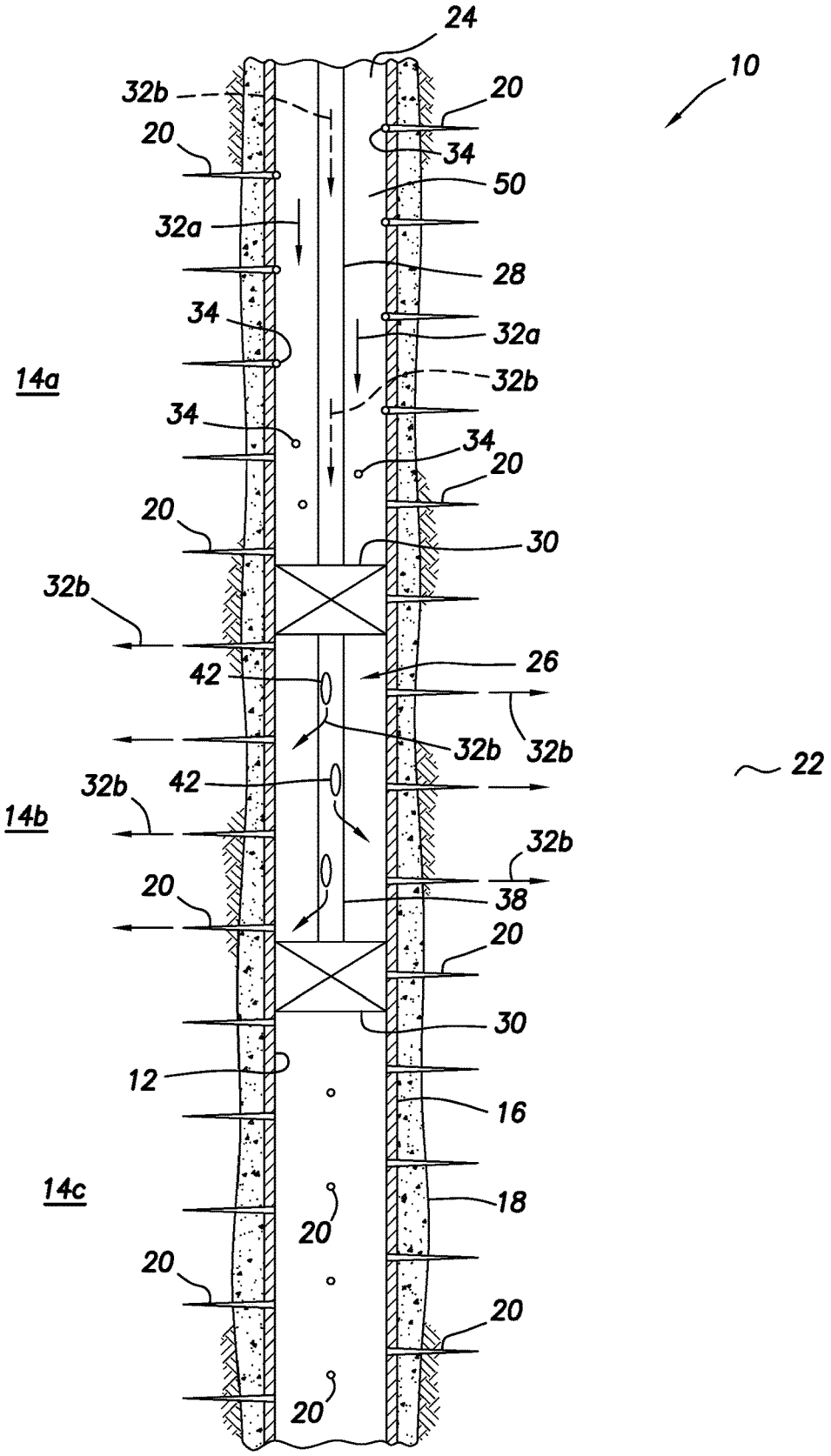
FIG. 9 is a representative partially cross-sectional view of another example of the system and method, with another example of the downhole tool assembly.

Referring additionally now to FIG. 9, another example of the tool assembly 26 as used in the system 10 is representatively illustrated. In this example, the steps of the method may be performed concurrently and continuously.

As depicted in FIG. 9, the tool assembly 26 includes two flow restrictors 30 spaced apart by the tubular mandrel 38. The flow restrictors 30 may be the same as, or similar to, any of the flow restrictors described herein. The conveyance 28 in this example is of the type known to those skilled in the art as coiled tubing, although other types of tubulars may be used in other examples.

A fluid 32*a* is pumped into an annulus 50 formed between the casing 16 inner diameter and the conveyance 28 in order to displace the tool assembly 26 along the wellbore. Alternatively, the conveyance 28 may be used to displace the tool assembly 26 without use of the fluid 32*a* to displace the tool assembly. A fluid 32*b* is pumped through an interior of the conveyance 28 to the tool assembly 26.

The fluid 32*b* is a treatment fluid and may be the same as, or different from, the fluid 32*a*. The fluid 32*b* exits the mandrel 38 via the ports 42 and flows into the perforations 20 between the flow restrictors 30 (or into a wall of the wellbore 12 if it is uncased).

Different fluids may be used in respective different steps of the method, or the same fluids may be used in all of the steps of the method. The fluids 32*a,b* (or either of them) may be the same as, or different from, the fluid 32 described above.

As depicted in FIG. 9, the fluid 32*a* is being used to displace the tool assembly 26 along the wellbore 12, and the fluid 32*b* is being used to treat the interval section 14*b* between the flow restrictors 30. The interval section 14*a* has already been treated, and plugging devices 34 are being used to block flow into perforations 20 extending into the interval section 14*a*. The plugging devices 34 are conveyed in the annulus 50 to the perforations 20 above the upper flow restrictor 30 by the flow of the fluid 32*a*. The interval section 14*c* will be treated when the tool assembly 26 is displaced further through the wellbore 12.

However, it should be understood that the interval sections 14*a-c* are not necessarily separately or individually treated using the FIG. 9 method. Instead, the interval sections 14*a-c* can be gradually and continuously treated as the tool assembly 26 displaces along the wellbore 12.

The plugging devices 34 may be continuously deployed into the annulus 50, so that they engage or otherwise block flow into the perforations 20 above the upper flow restrictor 30 as it displaces along the wellbore 12. Alternatively, a sufficient number or volume of diverter or plugging devices 34 could initially be disposed in the annulus 50 above the upper flow restrictor 30 prior to the treatment operation. The retainer 44 described above may be used to prevent the diverter or plugging devices 34 from contacting the upper flow restrictor 30.

In some examples, the interval sections 14*a-c* could be separately treated by displacing the tool assembly 26 so that the flow restrictors 30 straddle the perforations 20 of each interval section in succession. In this manner, greater control over treatment pressures and flow rates may be obtained for each of the individual interval sections 14*a-c*, if desired.

In the examples described above, the tool assembly 26 is described as being displaced along the wellbore 12 by flow of the fluid 32 or 32*a* into the wellbore above the tool assembly. Alternatives, such as, use of a tractor device or use of the conveyance 28 to push or pull the tool assembly 26 along the wellbore 12 are also described. In another alternative, a weight of the tool assembly 26 and/or the conveyance 28 may be sufficient to displace the tool assembly along the wellbore 12. Thus, the scope of this disclosure is not limited to any particular means of displacing the tool assembly 26 along the wellbore 12.

In the examples described above, it is not necessary for the diverter or plugging devices 34 to completely prevent or exclude the fluid 32 from flowing into the interval sections 14*a,b* when the diverter or plugging devices engage the perforations 20 or the wall of the wellbore 12. There may be some leakage past one or more of the diverter or the plugging devices 34 in some cases. It is sufficient for the diverter or plugging devices 34 to substantially block the fluid 32 from flowing into the interval sections 14*a,b* when the diverter or plugging devices engage the perforations 20 or the wall of the wellbore 12.

It may now be fully appreciated that the above disclosure provides to the art a well treatment system 10 and method, in which a first flow restrictor 30 is positioned in a wellbore 12 below a first interval section 14*a* to be treated, the flow restrictor 30 may be secured against displacement in the wellbore (such as, by setting an anchor, packer or bridge plug of the flow restrictor), the first interval section 14*a* is treated by flowing a fluid 32 into the first interval section 14*a*, diverter or plugging devices 34 are used to block flow of the fluid 32 into the first interval section 14*a*, and then the first flow restrictor 30 is positioned in the wellbore 12 below a second interval section 14*b* to be treated.

The second interval section 14*b* is treated by flowing a fluid 32 into the second interval section 14*b*, and diverter or plugging devices 34 may be used to block flow of the fluid 32 into the second interval section 14*b*.

The fluid 32 may be used to displace the first flow restrictor 30 along the wellbore 12.

The first flow restrictor 30 may be included in a tool assembly 26 secured to a conveyance 28 that limits displacement of the tool assembly 26 along the wellbore 12.

The tool assembly 26 in one example includes a second flow restrictor 30 longitudinally spaced apart from the first flow restrictor 30. The fluid 32*b* is flowed into the first interval section 14*a* straddled by the first and second flow restrictors 30 in this example.

The first interval section 14*a* and a second interval section 14*b* may be treated while the tool assembly 26 displaces along the wellbore 12.

The first flow restrictor 30 may restrict or prevent flow of the fluid 32 through an annulus 52 formed between the first flow restrictor 30 and an inner diameter of the wellbore 12.

The diverter or plugging devices 34 may be conveyed along the wellbore 12 with a tool assembly 26 that includes the first flow restrictor 30, such as, above a retainer 44 of the tool assembly 26.

The above disclosure provides to the art a method of treating a subterranean well. In one example, the method can include: positioning a first flow restrictor 30 in a wellbore 12 that penetrates an interval 14 of an earth formation 22; displacing the first flow restrictor 30 along the wellbore 12 away from a surface of the well; preventing longitudinal displacement of the first flow restrictor 30 in the wellbore 12; introducing flow into a first section 14*a* of the interval 14 from a section of the wellbore 12 between the first flow restrictor 30 and the surface; blocking the flow from the wellbore 12 section into the first interval section 14*a*; permitting longitudinal displacement of the first flow restrictor 30 in the wellbore 12; and displacing the first flow restrictor 30 along the wellbore 12 away from the surface of the well, thereby permitting unrestricted flow from the wellbore 12 section into a second section 14*b* of the interval 14. The second interval section 14*b* is farther along the wellbore 12 from the surface than the first interval section 14*a*.

In any of the examples described herein:

The preventing step may include setting the first flow restrictor 30.

The step of introducing flow into the first section 14*a* of the interval 14 may include the first flow restrictor 30 restricting fluid 32 flow from the wellbore 12 section into the second interval section 14*b*.

The blocking step may include plugging devices 34 preventing the flow into the first interval section 14*a*.

The plugging devices 34 may be disposed in the wellbore 12 section during the step of permitting flow into the first section 14*a* of the interval 14.

The plugging devices 34 may be released into the wellbore 12 section after the step of permitting flow into the first section 14*a* of the interval 14 and prior to the step of permitting unrestricted flow from the wellbore 12 section into the second section 14*b* of the interval 14.

The first flow restrictor 30 may be positioned between the first and second interval sections 14*a,b* during the step of introducing flow into the first section 14*a* of the interval 14 and prior to the step of permitting unrestricted flow from the wellbore 12 section into the second section 14*b* of the interval 14.

The second interval section 14*b* may be positioned between the first interval section 14*a* and the first flow restrictor 30 during the step of permitting unrestricted flow from the wellbore 12 section into the second section 14*b* of the interval 14.

The step of displacing the first flow restrictor 30 along the wellbore 12 away from the surface of the well, thereby permitting unrestricted flow from the wellbore 12 section into the second section 14*b* of the interval 14, may include displacing the first flow restrictor 30 by the flow.

The first flow restrictor 30 may be included in a tool assembly 26 secured to a conveyance 28 that limits displacement of the tool assembly 26 along the wellbore 12.

The tool assembly 26 may include a second flow restrictor 30 longitudinally spaced apart from the first flow restrictor 30. The step of introducing flow into the first section 14*a* of the interval 14 may include permitting flow into the first interval section 14*a* from the wellbore 12 between the first and second flow restrictors 30.

The tool assembly 26 may displace along the wellbore 12 during the step of introducing flow into the first section 14*a* of the interval 14.

The first flow restrictor 30 may restrict or prevent flow through an annulus 52 surrounding the first flow restrictor 30. The annulus 52 may be formed between the first flow restrictor 30 and an inner surface of the wellbore 12 (such as, an inner surface of a casing 16 or an inner wall of the wellbore 12).

The plugging devices 34 may be conveyed along the wellbore 12 with a tool assembly 26 that includes the first flow restrictor 30 during the step of introducing flow into the first section 14*a* of the interval 14.

A system 10 for treating a subterranean well is also provided to the art by the above disclosure. In one example, the system 10 can include a first flow restrictor 30 that restricts flow through an annulus 52 surrounding the first flow restrictor 30, the first flow restrictor 30 being releasably securable against longitudinal displacement in a wellbore 12 of the well; and plugging devices 34 disposed in a section of the wellbore 12 positioned between the first flow restrictor 30 and a surface of the well. Flow from the wellbore 12 section into a first section 14*a* of an interval 14 of an earth formation 22 is permitted prior to being blocked by the plugging devices 34.

In any of the examples described herein:

The first flow restrictor 30 may be connected to a conveyance 28 that restricts displacement of the first flow restrictor 30 along the wellbore 12. The displacement may be due to a pressure differential across the first flow restrictor 30.

Displacement of the first flow restrictor 30 along the wellbore 12 away from the surface of the well may permit unrestricted flow from the wellbore 12 section into a second section 14*b* of the interval 14.

The second interval section 14*b* may be farther along the wellbore 12 from the surface than the first interval section 14*a*.

The first flow restrictor 30 may restrict flow from the wellbore 12 section into the second interval section 14*b*.

The plugging devices 34 may be released into the wellbore 12 section after flow is permitted into the first interval section 14*a* and prior to unrestricted flow being permitted from the wellbore 12 section into the second interval section 14*b*.

The first flow restrictor 30 may be positioned between the first and second interval sections 14*a,b* while flow is permitted into the first interval section 14*a* and prior to unrestricted flow being permitted from the wellbore 12 section into the second interval section 14*b*.

The second interval section 14*b* may be positioned between the first interval section 14*a* and the first flow restrictor 30 when unrestricted flow is permitted from the wellbore 12 section into the second interval section 14*b*.

The plugging devices 34 may be disposed in the wellbore 12 section while flow into the first interval section 14*a* is permitted.

The first flow restrictor 30 may be displaced along the wellbore 12 away from the surface by flow through the wellbore 12.

The first flow restrictor 30 may be included in a tool assembly 26 secured to a conveyance 28 that limits displacement of the tool assembly 26 along the wellbore 12.

The tool assembly 26 may include a second flow restrictor 30 longitudinally spaced apart from the first flow restrictor 30. Flow into the first interval section 14*a* may be permitted from the wellbore 12 between the first and second flow restrictors 30.

The tool assembly 26 may displace along the wellbore 12 while flow into the first interval section 14*a* is permitted.

The plugging devices 34 may be conveyed along the wellbore 12 with a tool assembly 26 that includes the first flow restrictor 30 while flow is permitted into the first interval section 14*a*.

The term "above" is used in the above description to indicate a direction toward the surface along the wellbore 12 (which is not necessarily vertical at any particular section), and the term "below" is used to indicate a direction away from the surface along the wellbore.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa.

What is claimed is:

1. A method of treating a subterranean well, the method comprising:

positioning a first flow restrictor in a wellbore that penetrates an interval of an earth formation;

positioning a plugging device retainer in the wellbore between the first flow restrictor and a surface of the earth;

releasing plugging devices into the wellbore, in which the plugging device retainer is adapted to prevent the released plugging devices from displacing downward to the first flow restrictor;

displacing the first flow restrictor along the wellbore away from the surface;

preventing longitudinal displacement of the first flow restrictor in the wellbore;

introducing flow into a first section of the interval from a portion of the wellbore positioned between the plugging device retainer and the surface;

blocking the flow from the portion of the wellbore into the first interval section;

permitting longitudinal displacement of the first flow restrictor in the wellbore; and displacing the first flow restrictor along the wellbore away from the surface, thereby permitting unrestricted flow from the portion of the wellbore into a second section of the interval, in which the second interval section is farther along the wellbore from the surface than the first interval section.

2. The method of claim 1, in which the preventing comprises setting the first flow restrictor.

3. The method of claim 1, in which the introducing flow into the first section of the interval comprises the first flow restrictor restricting fluid flow from the portion of the wellbore into the second interval section.

4. The method of claim 3, in which the blocking comprises the plugging devices preventing the flow into the first interval section.

5. The method of claim 4, in which the plugging devices are released into the wellbore during the permitting flow into the first section of the interval.

6. The method of claim 4, in which the plugging devices are released into the wellbore after the permitting flow into the first section of the interval and prior to the permitting unrestricted flow from the portion of the wellbore into the second section of the interval.

7. The method of claim 1, in which the first flow restrictor is positioned between the first and second interval sections during the introducing flow into the first section of the interval and prior to the permitting unrestricted flow from the portion of the wellbore into the second section of the interval.

8. The method of claim 7, in which the second interval section is positioned between the first interval section and the first flow restrictor during the permitting unrestricted flow from the portion of the wellbore into the second section of the interval.

9. The method of claim 1, in which the displacing the first flow restrictor along the wellbore away from the surface, thereby permitting unrestricted flow from the portion of the wellbore into the second section of the interval, comprises displacing the first flow restrictor by the flow.

10. The method of claim 1, in which the first flow restrictor is included in a tool assembly secured to a conveyance that limits displacement of the tool assembly along the wellbore.

11. The method of claim 10, in which the tool assembly includes a second flow restrictor longitudinally spaced apart from the first flow restrictor.

12. The method of claim 11, in which the introducing flow into the first section of the interval comprises permitting flow into the first interval section from the wellbore between the first and second flow restrictors.

13. The method of claim 10, in which the tool assembly displaces along the wellbore during the introducing flow into the first section of the interval.

14. The method of claim 1, in which the first flow restrictor restricts or prevents flow through an annulus surrounding the first flow restrictor.

15. The method of claim 1, in which the plugging devices are conveyed along the wellbore with a tool assembly that includes the first flow restrictor during the introducing flow into the first section of the interval.

16. A system for treating a subterranean well, the system comprising:

a first flow restrictor that restricts flow through an annulus surrounding the first flow restrictor, the first flow restrictor being releasably securable against longitudinal displacement in a wellbore of the well;

a plugging device retainer disposed in a wellbore between the first flow restrictor and a surface of the earth; and plugging devices released into a portion of the wellbore positioned between the plugging device retainer and the surface, in which the plugging device retainer is adapted to space the released plugging devices longitudinally away from the first flow restrictor without restricting flow between the portion of the wellbore and the first flow restrictor, thereby permitting flow from the portion of the wellbore into a first section of an interval of an earth formation prior to the flow into the first interval section being blocked by the plugging devices.

17. The system of claim 16, in which the first flow restrictor is connected to a conveyance that restricts displacement of the first flow restrictor along the wellbore, the displacement being due to a pressure differential across the first flow restrictor.

18. The system of claim 16, in which displacement of the first flow restrictor along the wellbore away from the surface permits unrestricted flow from the portion of the wellbore into a second section of the interval.

19. The system of claim 18, in which the second interval section is farther along the wellbore from the surface than the first interval section.

20. The system of claim 18, in which the first flow restrictor restricts flow from the portion of the wellbore into the second interval section.

21. The system of claim 18, in which the plugging devices are released into the wellbore section after flow is permitted into the first interval section and prior to unrestricted flow being permitted from the portion of the wellbore into the second interval section.

22. The system of claim 18, in which the first flow restrictor is positioned between the first and second interval sections while flow is permitted into the first interval section and prior to unrestricted flow being permitted from the portion of the wellbore into the second interval section.

23. The system of claim 22, in which the second interval section is positioned between the first interval section and the first flow restrictor when unrestricted flow is permitted from the portion of the wellbore into the second interval section.

24. The system of claim 16, in which the plugging devices are released into the portion of the wellbore while flow into the first interval section is permitted.

25. The system of claim 16, in which the first flow restrictor is displaced along the wellbore away from the surface by flow through the wellbore.

26. The system of claim 16, in which the first flow restrictor is included in a tool assembly secured to a conveyance that limits displacement of the tool assembly along the wellbore.

27. The system of claim 26, in which the tool assembly includes a second flow restrictor longitudinally spaced apart from the first flow restrictor.

28. The system of claim 27, in which flow into the first interval section is permitted from the wellbore between the first and second flow restrictors.

29. The system of claim 26, in which the tool assembly displaces along the wellbore while flow into the first interval section is permitted.

30. The system of claim 16, in which the plugging devices are conveyed along the wellbore with a tool assembly that includes the first flow restrictor while flow is permitted into the first interval section.

* * * * *